US007559536B1

(12) United States Patent
Hansen et al.

(10) Patent No.: US 7,559,536 B1
(45) Date of Patent: Jul. 14, 2009

(54) STRUCTURAL GLASS RAILING BASE SHOE DESIGN

(76) Inventors: Tracy C. Hansen, 4860 NW. Shute Rd., Hillsboro, OR (US) 97124; Mark Evans, 4860 NW. Shute Rd., Hillsboro, OR (US) 97124

( * ) Notice: Subject to any disclaimer, the term of this patent is extended or adjusted under 35 U.S.C. 154(b) by 0 days.

(21) Appl. No.: 11/804,486

(22) Filed: May 18, 2007

(51) Int. Cl.
*E04H 17/16* (2006.01)

(52) U.S. Cl. ..... 256/25; 472/92; 52/293.3

(58) Field of Classification Search ..... 256/24, 256/25, 73, DIG. 6; 472/92, 94, 89; 52/293.3
See application file for complete search history.

(56) References Cited

U.S. PATENT DOCUMENTS 1,533,725 A * 4/1925 Davenport ..... 292/256
2,169,713 A * 8/1939 Stroud ..... 52/204.595
3,468,516 A * 9/1969 Jounot ..... 256/24
3,989,133 A * 11/1976 Courson et al. ..... 198/335
3,991,877 A * 11/1976 Kraft et al. ..... 198/335
4,054,268 A * 10/1977 Sher ..... 256/24
4,819,781 A * 4/1989 Saito et al. ..... 198/335
4,841,697 A * 6/1989 Hogg et al. ..... 256/24

* cited by examiner

*Primary Examiner*—Michael P Ferguson
(74) *Attorney, Agent, or Firm*—Michael J. Tavella

(57) ABSTRACT

A base shoe that uses a simple internal clamp system that makes initial installation and removal a very simple process. This system eliminates the need for grout and costly wedge systems. Stainless setscrews are mounted in one of the vertical legs of the base shoe and spaced at some interval. The stainless setscrews exert force on a stainless steel and neoprene compression plate, which exerts force on the glass panel. The opposite side of the glass panel then seats against a neoprene compression pad/setting block. This system allows for very easy glass installation, makes minor glass adjustments very simple, and allows for glass removal with a turn or two of the setscrews. Another important feature of this design is that the end users can insert temporary panels, such as wood, that can be installed as a temporary railing while the jobsite is waiting for the glass panels.

20 Claims, 6 Drawing Sheets

STRUCTURAL GLASS RAILING BASE SHOE DESIGN

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to structural glass railing base shoe designs and particularly to a structural glass railing base shoe design that uses no grout or wedges.

2. Description of the Prior Art

Structural glass railing systems with an extruded base shoe component have been rather common in the market for many years. These prior art systems utilize a U-shaped base extrusion called the base shoe to hold and support tempered glass panels. The glass panels are retained in the base shoe with either a grout material or mechanical wedges. The grouted application involves simply pouring liquid grout, cement, or other adhesive into the channel once the glass is properly positioned, thus locking the glass panel in place and creating a relatively permanent installation. If a glass panel should need to be removed due to breakage or some other reason, the hardened grout must be chipped away to clear the pocket before a new panel could be installed. Because workers are chipping out grout right next to some exposed glass edges of adjacent glass panels, this activity is very time consuming and possibly dangerous.

One recent solution to the grout problem is a system that replaces the grout with a system that uses a wedge-shaped piece that is pounded down on either side of the glass panels in conjunction with some vinyl pieces. This design is described in U.S. Pat. Nos. 6,419,209, 6,517056, and 7,036,799. The force produced by the wedge action is enough to hold the glass firmly. There is also a special tool that can actually pull the wedges out of the channel to facilitate a removal. However, this operation is difficult to do, and one must have this special tool to do it. Moreover, the wedges are driven into the base shoe using a special chisel type tool and a hammer. This type of installation increases the risk of damage to a glass panel during the installation.

BRIEF DESCRIPTION OF THE INVENTION

The instant invention solves these problems. It eliminates the wedges all together, and utilizes a simple internal clamp system that makes initial installation and removal a very simple process. Stainless setscrews are mounted in one of the vertical legs of the base shoe and spaced at some interval. The stainless setscrews exert force on a stainless steel and neoprene compression plate, which exerts force on the glass panel. The opposite side of the glass panel then seats against a neoprene compression pad. This system allows for very easy glass installation, makes minor glass adjustments very simple, and allows for glass removal with a turn or two of the setscrews. Another important feature of this design is that the installers can insert temporary panels, such as wood, that can be installed as a temporary railing while the jobsite is waiting for the glass panels.

DETAILED DESCRIPTION OF THE INVENTION

Figure 1:
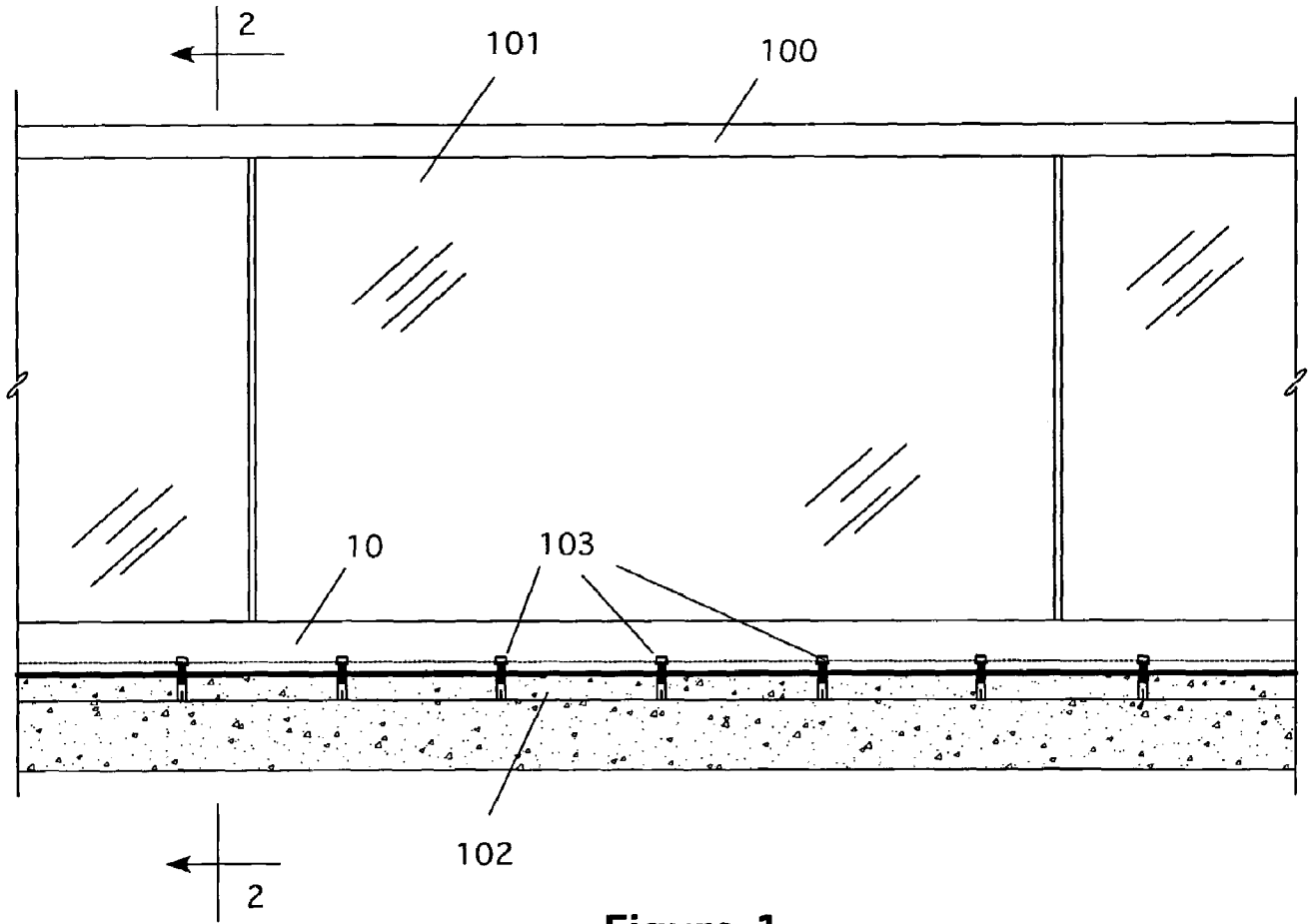
FIG. 1 is front elevation of a rail section using the improved base shoe.

Referring now to FIG. 1, a rail utilizing the new base shoe is shown. The railing has a top rail 100, a series of tempered glass panels 101, which are, in the preferred embodiment nominally ½ inch or ¾ inch thick and typically no more than 60 inches long. The glass panels are set into the base shoe 10 the structure of which is discussed below.

The base shoe 10 is typically set on a concrete surface 102 and is held in place, in the preferred embodiment using typical fasteners 103 such as expansion anchors, threaded rod and epoxy, lag bolts, or through bolts spaced at approximately 12 inch intervals. Of course, any other suitable fastening system can be utilized.

Figure 2:
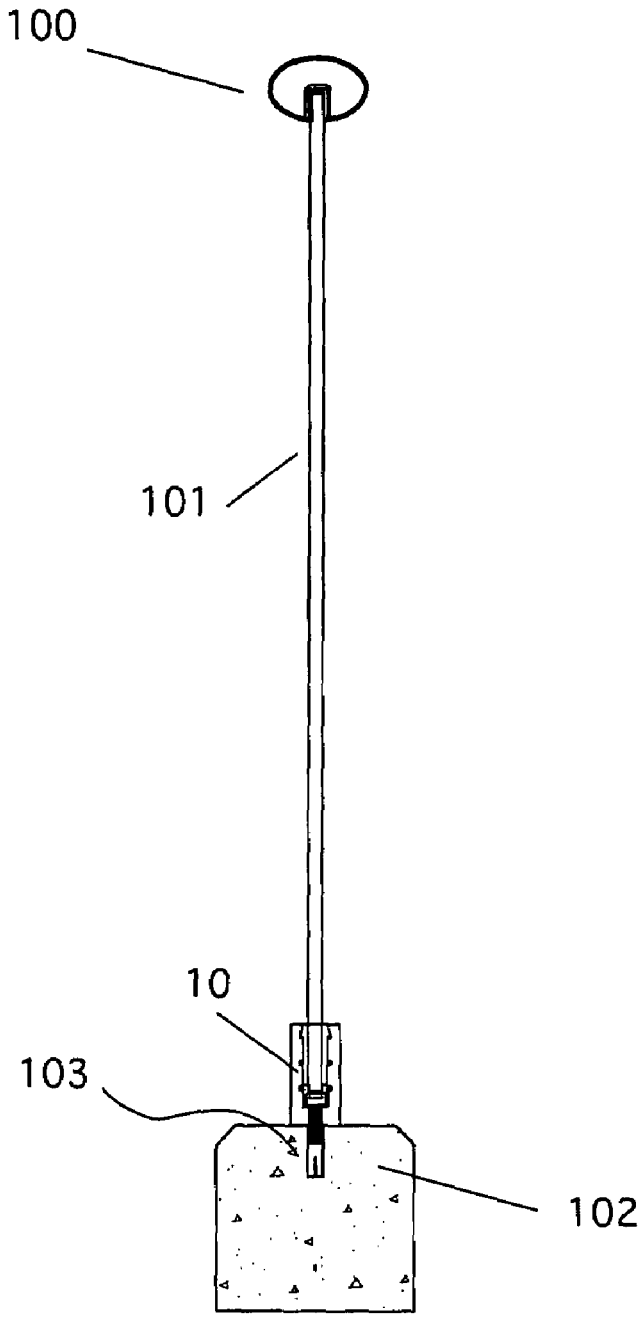
FIG. 2 is an enlarged cross-section of rail taken along the lines 2-2 of FIG. 1.

FIG. 2 is an enlarged cross-section of rail taken along the lines 2-2 of FIG. 1. Here, the top rail 100, tempered glass panel 101, base shoe 10, curb 102 and fasteners 103 are shown.

Figure 3:
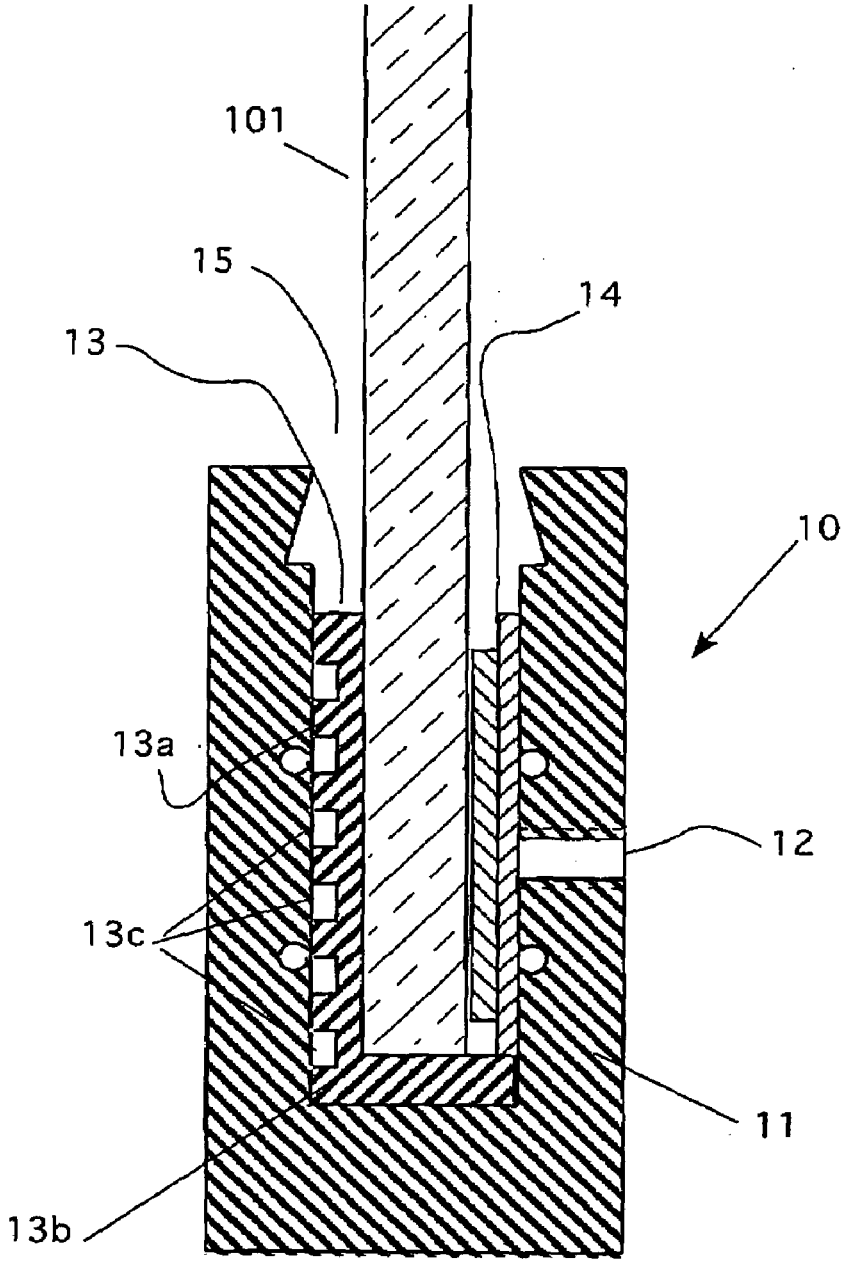
FIG. 3 is a cross-sectional detail view of the base shoe.
Figure 4:
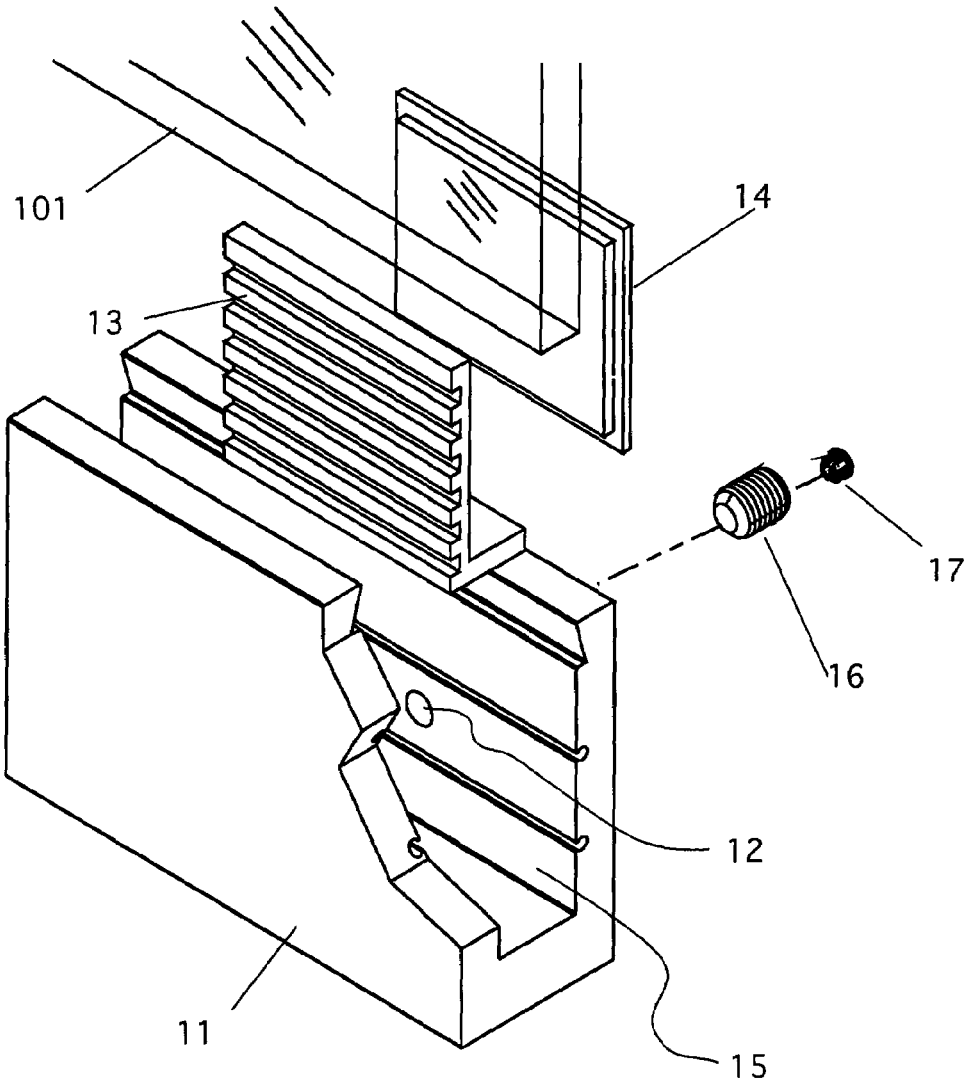
FIG. 4 is an assembly detail view of the base shoe assembly.

FIG. 3 is a cross-sectional detail view of the base shoe 10. FIG. 4 is an assembly detail view of the base shoe assembly. Here, all of the components are shown in a partially exploded view. The base shoe has a number of components that are assembled into the final shoe assembly. First, there is the outer shoe 11. In the preferred embodiment, the outer shoe 11 is made of aluminum and is nominally 2 inches wide and 4 inches high. It has a base and two upright side walls as shown. Of course, the dimensions may be varied within the normal scope of use. One of the vertical side walls of the outer shoe has a threaded hole 12 formed in it to accept a setscrew, as described below. In the preferred embodiment, the length of the outer shoe is selected to limit splicing as much as possible and is balanced by the weight of the shoe. Thus, typical lengths of shoe are preferably 15 feet. The setscrew holes 12 are positioned along the length of shoe and are preferably spaced at 12-18 inch intervals along the outer shoe 10. This spacing depends on factors such as the height of the rail and the wind load on the system. The outer shoe has an inner channel 15 that accepts the glass panels 101 as well as the components used to support the panels A vinyl compression pad 13 is positioned in the bottom of the channel 15 as shown. In the preferred embodiment, the vinyl compression pad 13 is three inches long, positioned on the opposite side from the setscrew hole 12, and is centered thereon. The vinyl compression pad 13 has a vertical back portion 13*a* and a base portion 13*b*. The vertical back portion 13*a* has a number of ribs 13*c* that provide support for the glass once it is installed.

The glass panel can then be inserted into the channel and set upon the base 13*b* of the vinyl compression pad 13. Next, a pressure plate 14 is slid into the space between the glass panel and the side of the outer shoe that has the setscrew hole 12. This plate has a thin stainless steel plate 20 and a neoprene pad 21 (see FIGS. 6 and 7). Here, the components are shown aligned for installation. A setscrew 16 and a cap plug 17 are shown in this view. Once the components are in place as shown in FIG. 4, the setscrew 16 can be installed and tightened to compress both the vinyl compression pad 13 and the neoprene pad 21 of the compression pad to lock the glass panel in place. Once the installation is complete, the setscrew holes can be covered with the cap plugs 17. The cap plugs can be removed, which allows easy access to the setscrews to replace a broken panel, to adjust a panel as needed or to replace panels that might be used as a temporary barrier (these can be wood, metal or composite).

Figure 5:
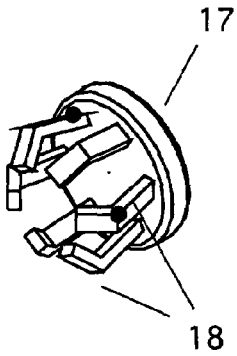
FIG. 5 is an enlarged detail of the cap plug.

FIG. 5 is an enlarged detail of the cap plug 17. Here, the cap plug 17 is shown with a number of spring feet 18 that allow the cap to be removed.

Figure 6:
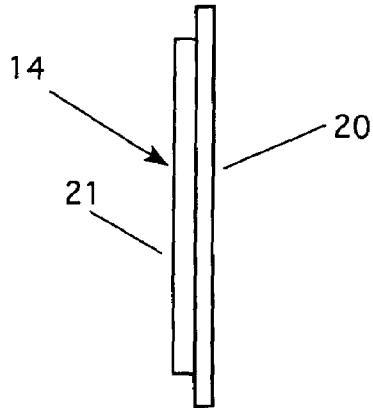
FIG. 6 is a side view of the pressure plate.
Figure 7:
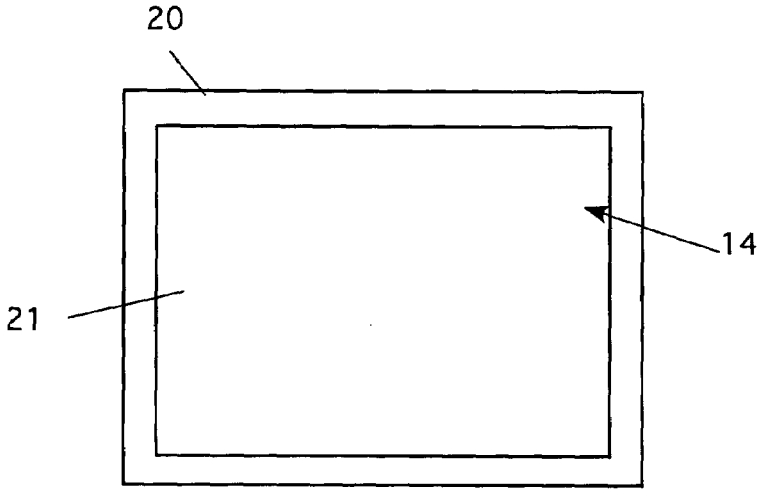
FIG. 7 is a front view of the pressure plate.

FIG. 6 is a side view of the pressure plate. FIG. 7 is a front view of the pressure plate. As discussed above, this pad has a thin stainless steel plate 20 and a neoprene pad 21. An alternative to the neoprene pad is Ethylene Propylene Diene Monomer (EPDM), which is a rubber compound.

Figure 8:
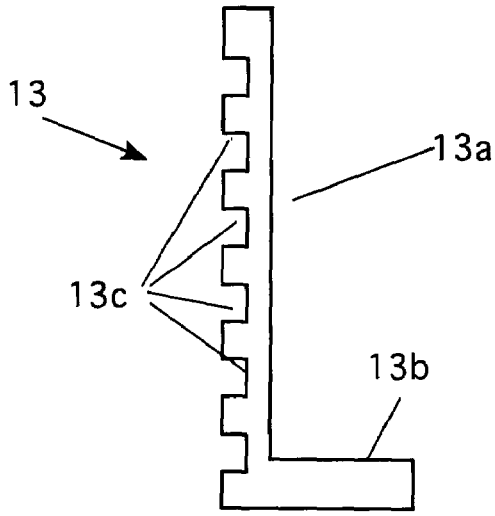
FIG. 8 is a side view of the vinyl compression pad.
Figure 9:
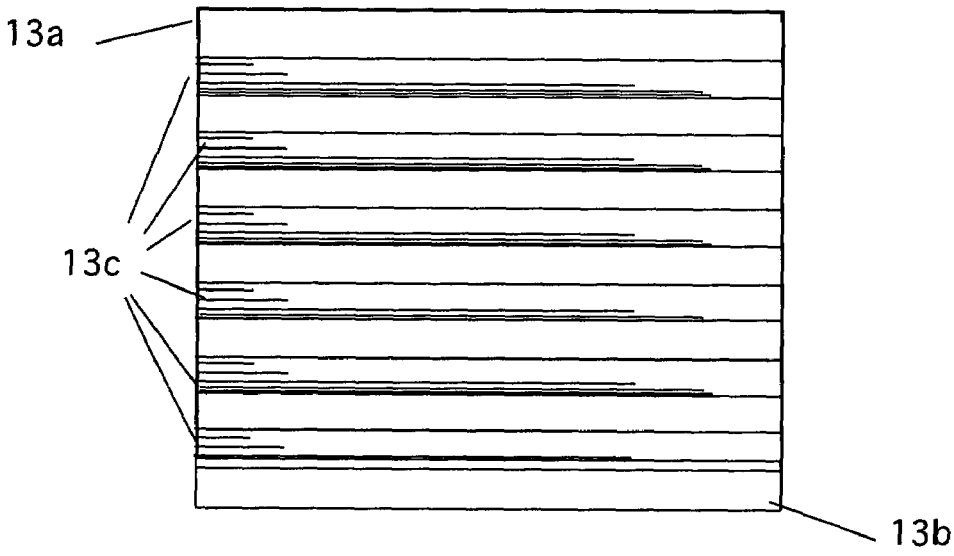
FIG. 9 is a front view of the vinyl compression pad.

FIG. 8 is a side view of the vinyl compression pad and FIG. 9 is a front view of the vinyl compression pad. As discussed above, the vinyl compression pad 13 has a vertical back portion 13*a* and a base portion 13*b*. The vertical back portion 13*a* has a number of ribs 13*c* that provide support for the glass once it is installed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A base shoe for railings containing panels comprising:

a) a base having a bottom and a pair of sidewalls having an open channel formed therebetween;

b) a means for accepting at least one means for holding a panel in place, formed in one of said pair of sidewalls;

c) a compression pad, having a horizontal base and a vertical upright portion forming an L-shape, said compression pad being positioned in said open channel such that one side of a panel having two planar sides is positioned against said vertical upright portion of said compression pad and the horizontal base is positioned under an edge of the panel positioned against said compression pad, said compression pad further comprising at least one rectangular groove formed in a side of said vertical upright portion, said at least one groove forming support ribs for the panel and further wherein when said compression pad is positioned within said open channel, said at least one groove is positioned against one of said pair of sidewalls;

d) a compression plate having a rectangular cross-section, slidably installed in said open channel such that it rests against the other side of said panel installed in said shoe such that the panel is between the compression pad and the compression plate; and e) a means for holding a panel in place, placed in said means for accepting at least one means for holding a panel in place the holding means applying a clamping force to the compression plate to clamp the panel between the compression pad and the compression plate.

2. The base shoe of claim 1 wherein the means for accepting at least one means for holding a panel in place comprises at least one hole formed in a first sidewall of said base.

3. The base shoe of claim 1 wherein the means for holding a panel in place comprises a removable mechanical fastener.

4. The base shoe of claim 3 wherein the mechanical fastener comprises a setscrew.

5. The base shoe of claim 1 further comprising a glass panel installed in said open channel.

6. The base shoe of claim 1 wherein the compression pad is made of vinyl.

7. The base shoe of claim 1 wherein the compression plate is a generally rectangular metal plate.

8. The base shoe of claim 7 wherein the compression plate further comprises a resilient pad, attached to said metal plate.

9. The base shoe of claim 8 wherein the resilient pad is made of a material selected from the group of neoprene or Ethylene Propylene Diene Monomer.

10. A base shoe for railings containing panels comprising:

a) a base;

b) a first upright wall, attached to the base and extending upwardly therefrom said first upright wall having a means for accepting at least one setscrew formed therein;

c) a second upright wall, attached to the base and extending upwardly therefrom in spaced apart relationship with said first upright wall, thereby forming a channel for receiving a panel therebetween;

d) a compression pad, having a horizontal base and a vertical upright portion forming an L-shape, said compression pad being positioned such that the horizontal base sits upon the base of said base shoe such that an edge of a panel, having two planar sides, installed in said base shoe sits upon said horizontal base and further wherein one side of said panel rests against said vertical upright portion, said compression pad further comprising at least one rectangular groove formed in said vertical upright portion of said compression pad, said at least one groove forming support ribs for the panel and further wherein said at least one groove is placed against one of said pair of sidewalls when said compression pad is positioned within said base shoe;

e) a compression plate having a rectangular cross-section, slidably installed in said base shoe such that it rests against the other side of said panel installed in said shoe such that the panel is between the compression pad and the compression plate; and f) a setscrew placed in said means for accepting at least one setscrew formed therein and further wherein said setscrew protrudes through said first upright wall and makes positive contact with said compression plate to clamp the panel between the compression pad and the compression plate.

11. A method of installing a panel in a base shoe having a base, a first upright wall, attached to the base and extending upwardly therefrom said first upright wall having a means for accepting at least one fastener formed therein, and a second upright wall, attached to the base and extending upwardly therefrom in spaced apart relationship with said first upright wall, thereby forming a channel for receiving a panel therebetween, comprising the steps of:

a) placing a compression pad having a horizontal base and a vertical upright portion forming an L-shape in said channel such that the vertical upright portion of said compression pad rests against said second upright wall, said compression pad further comprising at least one rectangular groove formed in said vertical upright portion of said compression pad, said at least one groove forming support ribs for the panel and further wherein said at least one groove is placed against said second upright wall;

b) positioning a panel having two planar sides in said channel such that a side of said panel rests against said compression pad and an edge of the panel rests on the horizontal base of said compression pad;

c) positioning a compression plate having a rectangular cross-section in said channel such that said compression plate rests against the other side of said panel and is further aligned with said means for accepting at least one fastener;

d) placing a mechanical fastener in said means for accepting at least one fastener; and e) tightening said mechanical fastener against said compression plate to clamp the panel between the compression pad and the compression plate until said panel is secure in said base shoe.

12. The method of claim 11 further comprising the steps of:

i) after step (a) and before step (b), forming a plurality of means for accepting at least one fastener formed therein in said first upright wall;

ii) after step (b), installing a plurality of compression pads in said channel, each of said compression pads having a horizontal base and a vertical upright portion forming an L-shape, such that the vertical upright portion of said compression pad rests against said second upright wall, said compression pad further comprising at least one rectangular groove formed in said vertical upright portion of said compression pad, said at least one groove forming support ribs for the panel and further wherein said at least one groove is placed against said second upright wall;

iii) after step (d), installing a plurality of compression plates, each of said plurality of compression plates having a rectangular cross-section, in said channel such that each of said plurality of compression plates rests against said first upright wall and further wherein each of said plurality of compression pads is aligned with one of said plurality of means for accepting at least one fastener formed therein; and iv) after step (d), placing a mechanical fastener in each of said plurality of means for accepting at least one fastener; and iv) after step (e), tightening each of said mechanical fasteners against each of said plurality of compression plates until said panel is secure in said base shoe.

13. The method of claim 11 wherein the means for accepting at least one fastener comprises at least one hole formed in said first upright portion.

14. The method of claim 11 wherein the mechanical fastener comprises a setscrew.

15. The method of claim 11 wherein the panel is made of glass.

16. The method of claim 11 wherein the compression pad is made of vinyl.

17. The method of claim 11 wherein the compression plate is a generally rectangular metal plate.

18. The method of claim 17 wherein the compression plate further comprises a resilient pad, attached to said metal plate.

19. The method of claim 18 wherein the resilient pad is made of a material selected from the group of neoprene or Ethylene Propylene Diene Monomer.

20. The method of claim 11 wherein the panel is made of a material selected from the group of: wood, metal or a composite material.

* * * * *